US006145578A

United States Patent [19]

Zearbaugh et al.

[11] Patent Number: 6,145,578

[45] Date of Patent: Nov. 14, 2000

[54] SPRING UNIT FOR CORE PIN ASSEMBLY

[75] Inventors: Francis E. Zearbaugh, deceased, late of Muncie; by Lucinda Pauline Webb, Heir, Eaton, both of Ind.; by Scott Richard Zearbaugh, Heir, Milford, Ohio; by Darlene K. Zearbaugh, Heir, Muncie; by Wayne Clayton Zearbaugh, legal representative, Albany, both of Ind.

[73] Assignee: Wayne C. Zearbaugh, Albany, Ind.

[21] Appl. No.: 09/134,979

[22] Filed: Aug. 17, 1998

[51] Int. Cl.[7] ..... B22D 33/04

[52] U.S. Cl. ..... 164/340; 164/341; 164/347

[58] Field of Search ..... 164/340, 341, 164/137, 347

[56] References Cited

U.S. PATENT DOCUMENTS

| | | | |
|---|---|---|---|
| 3,161,918 | 12/1964 | Zearbaugh | 164/340 |
| 3,899,282 | 8/1975 | Jesse | 164/347 |
| 5,730,200 | 3/1998 | Landna | 164/137 |
| 5,865,241 | 2/1999 | Bishenden et al. | 164/347 |

*Primary Examiner*—Harold Pyon
*Assistant Examiner*—I.-H. Lin
*Attorney, Agent, or Firm*—Lundy and Associates

[57] ABSTRACT

A spring unit for a core pin assembly for use in molding and die casting apparatus which can be installed in and removed from a mold section as a single unit.

10 Claims, 1 Drawing Sheet

SPRING UNIT FOR CORE PIN ASSEMBLY

BACKGROUND OF THE INVENTION

This invention relates generally to core pin assemblies for molding and die casting apparatus, and more particularly to a spring unit for a core pin assembly.

U.S. Pat. No. 3,161,918 discloses a core pin assembly for use in die casting and molding apparatus. That assembly provided a sleeve mounted in an opening extending from the parting surface of the mold section, the sleeve having a head engaging a shoulder in the opening thereby preventing movement of the sleeve in the direction toward the parting surface. The sleeve has a tapered bore which diverges toward the parting surface and a core pin having a mating taper is seated in that bore, the taper thus preventing movement of the core pin relative to the sleeve in the direction away from the parting surface. The core pin has an end extending beyond the head on the sleeve member. The opening has a bottom and a coil spring in the opening exerts force between the bottom and a washer which engages the head on the sleeve member thereby resisting movement of the sleeve member and a core pin in the direction away from the parting surface. An abutment pin is positioned within the spring with one end removably attached to the bottom of the opening by a screw and its other end normally closely spaced from the end of the core pin.

It is necessary on occasion to disassemble the core pin assembly and with the construction shown in the aforesaid U.S. Pat. No. 3,161,918, such disassembly resulted in a collection of separate parts including the washer, spring, abutment pin and screw, which easily could become lost. Further, re-assembly of the core pin assembly was time consuming and the assembly could be improperly reassembled.

It is therefore desirable to provide an improved core pin assembly which will alleviate the aforesaid problems encountered in the disassembly and re-assembly of the construction of the aforesaid U.S. Pat. No. 3,161,918.

SUMMARY OF THE INVENTION

The invention relates to molding apparatus which includes a mold section having a parting surface, the section having an opening therein which has a first portion which opens through the surface and a second portion forming an extension of the first portion with means being provided forming a bottom for the second opening portion. A core pin assembly is positioned in the opening and includes a sleeve member received in the first opening portion and having one end exposed to the second opening portion with means being provided for preventing movement of the sleeve member in the direction toward the parting surface. The sleeve member has a bore therein and a core pin is received in the bore with means being provided for preventing movement of the core pin with respect to the sleeve member in the direction away from the parting surface, the core pin having one end extending beyond the one end of the sleeve member into the second opening portion.

In accordance with the invention, the core pin assembly further includes a spring assembly which comprises a second sleeve member in the second opening portion and having first and second ends with the first end thereof engaging the one end of the first-named sleeve member, the second end of the second sleeve member being normally spaced from the opening bottom. A retainer member is provided movably mounted on the second sleeve member, the retainer member having a portion engaging the opening bottom. The second sleeve member has means thereon for forming an abutment and spring means is provided surrounding the second sleeve member for exerting force between the retainer member and the abutment means so as to force the first end of the second sleeve member into engagement with one end of the first sleeve member thereby resisting movement of the first sleeve member and core pin in a direction away from the parting surface. The second sleeve member has a bore therethrough with the one end of the core pin extending therein. An abutment pin is provided movably received in the bore of the second sleeve member and having first and second ends with the first end thereof normally spaced from the one end of the core pin and its second end engaging the opening bottom.

In a specific embodiment, means is provided for retaining the second sleeve member as the retainer member and means is also provided for preventing removal of the abutment pin from the second sleeve member bore thereby permitting removal of the spring assembly as a unit from the second opening portion.

It is accordingly an object of the invention to provide an improved core pin assembly for use in molding and die casting apparatus.

Another object of the invention is to provide a spring unit for a core pin assembly.

The above-mentioned and other features and objects of this invention and the manner of attaining them will become more apparent and the invention itself will be best understood by reference to the following description of an embodiment of the invention taken in conjunction with the accompanying drawings.

BRIEF DESCRIPTION OF THE DRAWING

The single FIGURE of the drawing is a cross-sectional view showing a core pin assembly incorporating the spring unit of the invention.

DESCRIPTION OF A SPECIFIC EMBODIMENT

Figure 1:
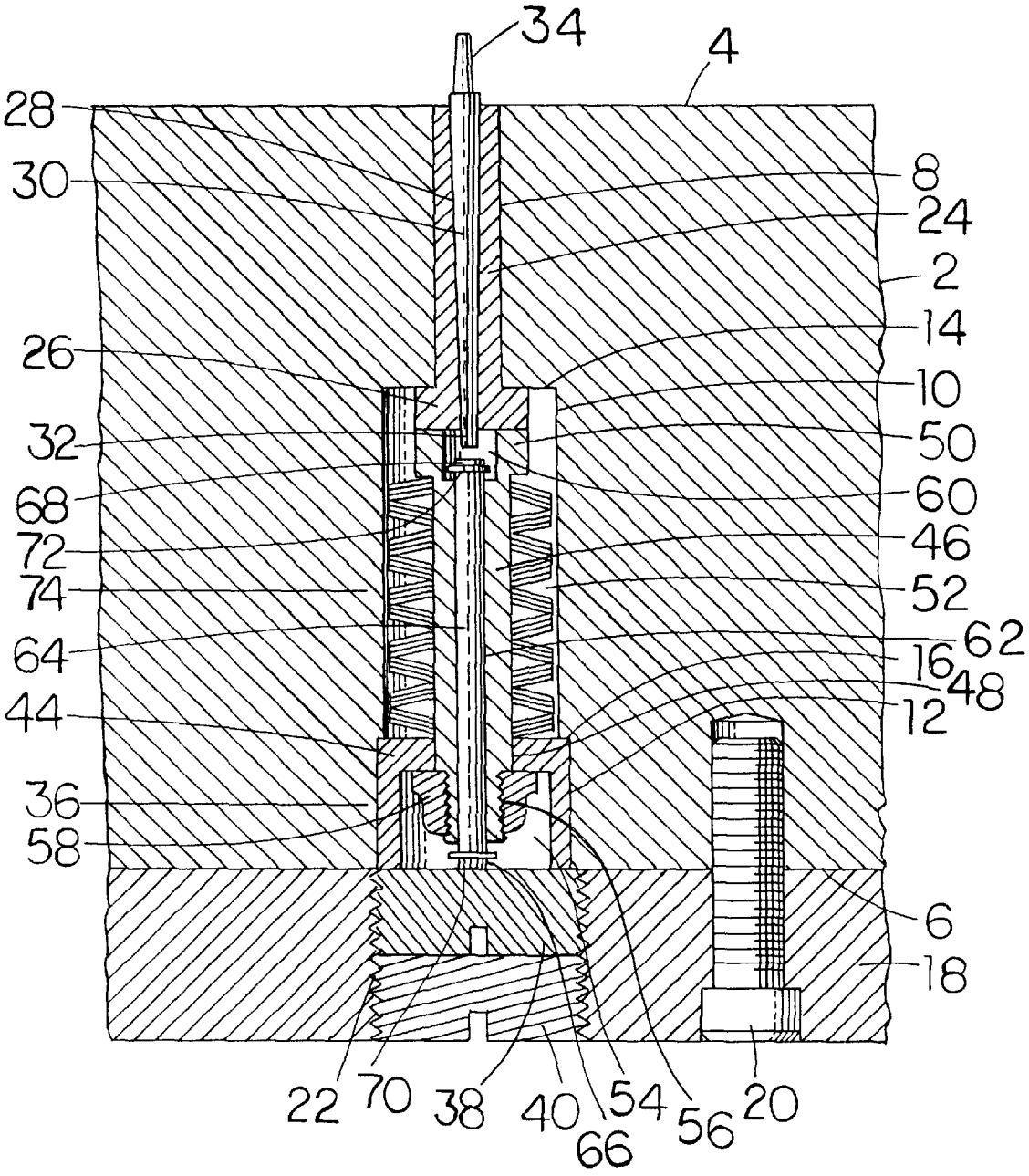

In describing the present invention, reference may be had to the aforesaid U.S. Pat. No. 3,161,918 for further description of the die casting apparatus and core pin assembly, mold assembly with which the spring assembly of the invention may be employed. The specification, Column 2, line 1 through Column 5, line 54 and all drawings of U.S. Pat. No. 3,161,918 is incorporated herein by reference as if reproduced herein.

Referring now to the drawing, there is shown a fragment of a mold section 2 which has parting surface 4 and bottom or rear surface 6. A cylindrical opening or bore is formed between parting surface 4 and rear surface 6 consisting of small diameter portion 8, intermediate diameter portion 10, and larger diameter portion 12, annular shoulder 14 separating portions 8 and 10 and annular shoulder 16 separating portions 10 and 12. Back plate 18 is secured to mold section 2, as by threaded fasteners 20, and has a threaded opening 22 therein forming an extension of larger diameter bore portion 12.

Cylindrical sleeve 24 is snugly received in bore portion 8 and has annular head 26 in bore portion 10 normally engaging shoulder 14 thereby preventing movement of sleeve 24 in the direction toward parting surface 4. Sleeve 24 has tapered bore 28 extending coaxially therethrough, bore 28 tapering divergently from head 26 toward parting surface 4. Core pin 30 having a taper which compliments or matches the taper of bore 28 of sleeve 8 is snugly received in bore 28 and has end 32 projecting beyond head 26. End 34 of core pin 30 projects beyond parting surface 4 and is conventionally tapered divergently toward surface 4. The mating tapers of bore 28 of sleeve 24 and of core pin 30 prevent movement of core pin 30 relative to sleeve 24 in the direction away from parting surface 4, i.e., downwardly as viewed in the drawing.

Cup-shaped retainer member 36 is seated in bore portion 12 being retained therein by set screws 38, 40 threadedly seated in bore 22 in plate 18, set screw 38 thus forming a bottom for bore portion 12. Annular flange portion 42 of retainer member 36 is thus engaged by set screw 38 and bottom portion 44 engages shoulder 16.

A second sleeve member 46 is provided movably extending through opening 48 in bottom portion 44 of retainer member 36. Sleeve 46 has annular head portion 50 thereon normally engaging head portion 26 of sleeve 24. In the illustrated embodiment, a plurality of belleville spring washers 52 surround sleeve 46 and exert force between bottom portion 44 of retainer member 36 and head portion 50 of sleeve 46 so as to force head portion 50 into engagement with head portion 26 of sleeve 24 and, in turn, to force head portion 26 into engagement with shoulder 14, thereby resisting movement of sleeve 24 and core pin 30 in the direction away from parting surface 4.

Annular flange portion 42 and bottom portion 44 of retainer member 36 define annular cavity 54. End 56 of sleeve member 46 extends into cavity 54 and is normally spaced from set screw 38. Lock nut 58 threadedly engages end 56 of sleeve 46 thus retaining sleeve member 46 on retainer member 36.

Sleeve member 46 has a cylindrical bore coaxially extending therethrough consisting of a larger diameter portion 60 extending into head portion 50 and a smaller diameter portion 62. End 32 of core pin 30 extends into bore portion 60. Abutment pin 64 is movably seated in bore 62 with its bottom end 66 extending into cavity 54 and engaging set screw 38 and its upper end 68 extending into bore portion 60 and normally closely spaced from end 32 of core pin 30. Abutment pin 64 is retained in bore 62 by snap rings 70, 72 on its opposite ends 66, 68.

Core pin 30 may be removed from sleeve 24 by impacting the exposed end of sleeve 24 with a tool of the type shown in FIG. 6 of U.S. Pat. No. 3,161,918. Sleeve 24 and core pin 30 are thus moved downwardly as viewed in the drawing, head 26 of sleeve 24 moving downwardly against spring 52. End 66 of abutment pin 64 engages set screw 38 and thus abutment pin 64 does not move as sleeve 24, core pin 30 and sleeve 24 are driven downwardly. End 68 of abutment pin 64 thus engages end 32 of core pin 30 breaking the taper lock of core pin 30 with sleeve 24 so as to permit removal of the core pin.

It will now be seen that spring assembly or unit 74 is provided comprising sleeve member 46, belleville spring washers 52, retainer member 36, and abutment pin 64, spring unit 74 being retained in assembled relation by lock nut 58 and snap rings 70, 72, thus permitting assembly and disassembly of spring unit 74 as a single unit with respect to the mold block 2.

While the use of belleville spring washers 52 to form the spring is preferred in order to obtain greater force to resist the high pressure of material in the mold cavity, it will be understood that a conventional coil spring may be substituted for the belleville spring washers 52 in instances where a lesser spring force is required. Further, while the use of set screws 38, 40 is preferred in order to permit assembly and disassembly of the spring unit 74 to and from, respectively, the mold block 2 without the necessity for removing plate 18, it will be readily seen that set screws 38, 40 may be eliminated and bore portion 12 closed by plate 18. Alternatively, plate 18 may be eliminated and set screws 38, 40 threadedly seated in bore portion 12.

It will now be readily seen that the improved spring unit of the invention facilitates assembly and disassembly of the core pin assembly to and from, respectively, the mold block 2 and further eliminates the problems previously encountered with respect to parts becoming mislaid. Still further, an inventory of spring units 74 of different force may be maintained, each of them being previously calibrated.

While a specific embodiment of the invention has been shown and described herein for purposes of illustration, the protection afforded by any patent which may issue upon this application is not strictly limited to the disclosed embodiment; but rather extends to all structures and arrangements which fall fairly within the scope of the claims which are appended hereto:

What is claimed is:

1. A spring unit for core pin assembly for use in molding and die casting apparatus including a mold section having a parting surface, said section having an opening therein, said opening having a first portion which opens through said surface and a second larger portion forming an extension of said first portion, means for forming a bottom for said second opening portion, and a core pin assembly in said opening and including a sleeve member received in said first opening portion and having one end exposed to said second opening portion, first means and said second opening portion including first engagement surfaces thereon for preventing movement of said sleeve member in the direction toward said surface, said sleeve member having a bore therein, a core pin received in said bore, and second means and said sleeve member having second engagement surfaces thereon for preventing movement of said core pin with respect to said sleeve member in the direction away from said surface, said core pin having one end extending beyond said one end of said sleeve member into said second opening portion; the improvement wherein said core pin assembly further includes a spring assembly comprising a second sleeve member in said second opening portion having first and second ends with said first end thereof engaging said one end of said first sleeve member and said second end thereof normally spaced from said bottom, a retainer member movably mounted on said second sleeve member, said retainer member having a portion engaging said bottom, said second sleeve member having an abutment surface for a third abutment surface with said first mean, spring means surrounding said second sleeve member and exerting force between said retainer member and said abutment means for forcing said first end of said second sleeve member into engagement with said one end of said first sleeve member thereby resisting movement thereof in the direction away from said surface, said second sleeve member having a bore therethrough, said one end of said core pin extending into said second sleeve member bore, and an abutment pin movably received in said second sleeve member bore and having first and second ends with said first end thereof normally spaced from said one end of said core pin and said second end thereof engaging said bottom.

2. The assembly of claim 1 further comprising means for retaining said second sleeve member on said retainer member.

3. The assembly of claim 2 further comprising means for preventing removal of said abutment pin from said second sleeve member bore.

4. The assembly of claim 3 further comprising means for retaining said second sleeve member on said retainer member and permitting removal of said spring assembly as a unit from said second opening portion.

5. The assembly of claim 1 wherein said spring means comprises a plurality of belleville spring washers.

6. The assembly of claim 1 wherein said section has a bottom surface opposite said parting surface, said second opening portion opening through said bottom surface, said bottom forming means comprising a plug threadedly seated in said second opening portion.

7. The assembly of claim 1 wherein said opening portions have a shoulder therebetween, said first movement preventing means comprises a head on said one end of said first sleeve member which normally engages said shoulder, said second movement preventing means comprises said first sleeve member bore being divergently tapered toward said surface and said core pin having a taper which matches that of said first sleeve member bore, said abutment means of said second sleeve member engaging said head portion of said first sleeve member.

8. The assembly of claim 7 wherein said abutment means comprises a head portion on said first end of said second sleeve member.

9. The assembly of claim 8 wherein said retainer member comprises a cup-shaped member having a flange portion and a bottom portion mutually defining a cavity, said flange portion engaging said second opening portion bottom and said bottom portion having an opening formed therein with said second sleeve member movably extending therethrough, said spring means acting between said head portion of said second sleeve member and said cup-shaped member bottom portion, said second end of said second sleeve member extending into said cavity, and further comprising means on said second end of said second sleeve member and engageable with said bottom portion of said cup-shaped member for retaining said second sleeve member on said cup member, and means on said abutment pin respectively adjacent said first and second ends for preventing removal thereof from said second sleeve member bore thereby permitting removal of said spring assembly as a unit from said second opening portion.

10. The assembly of claim 9 wherein said spring means comprises a plurality of belleville spring washers.

* * * * *